US005745961A

United States Patent [19]

Okawa et al.

[11] Patent Number: 5,745,961

[45] Date of Patent: May 5, 1998

[54] SURFACE FASTENER

[75] Inventors: Mitsuhisa Okawa; Ryuichi Murasaki, both of Toyama-ken, Japan

[73] Assignee: YKK Corporation, Tokyo, Japan

[21] Appl. No.: 769,127

[22] Filed: Dec. 19, 1996

[30] Foreign Application Priority Data

Dec. 22, 1995 [JP] Japan ..... 7-335272

[51] Int. Cl.[6] ..... A44B 13/00

[52] U.S. Cl. ..... 24/446; 24/442; 24/450

[58] Field of Search ..... 24/446, 447, 448, 24/450, 451, 452, 442

[56] References Cited

U.S. PATENT DOCUMENTS

| | | | |
|---|---|---|---|
| 2,662,559 | 12/1953 | Miller | 24/442 |
| 3,130,111 | 4/1964 | Izumi | 24/446 |
| 3,387,345 | 6/1968 | Savoir | 24/446 |
| 3,461,513 | 8/1969 | Girard et al. | 24/450 |
| 5,231,738 | 8/1993 | Higashinaka | 24/446 |
| 5,369,853 | 12/1994 | Okawa et al. | 24/446 |
| 5,515,583 | 5/1996 | Higashinaka . | |

FOREIGN PATENT DOCUMENTS

| | | |
|---|---|---|
| 883298 | 11/1961 | United Kingdom . |
| 1299897 | 10/1969 | United Kingdom . |

*Primary Examiner*—Victor N. Sakran
*Attorney, Agent, or Firm*—Hill & Simpson

[57] ABSTRACT

In a surface fastener, a multiplicity of hook-shape male engaging elements each formed of monofilament, a multiplicity of pile-like female engaging elements each formed of a multifilament, and a multiplicity of cut piles each formed of a set of fibers of a multifilament stand mixedly from a front surface of a woven or knit substrate.

11 Claims, 5 Drawing Sheets

SURFACE FASTENER

BACKGROUND OF THE INVENTION

1. Field of the Invention

This invention relates to a touch-and-close-type surface fastener, and more particularly to a composite surface fastener having a multiplicity of male and female engaging elements standing in a mixed order from a front surface of a substrate.

2. Description of the Related Art

A surface fastener of the composite type (hereinafter called the composite surface fastener) in which a multiplicity of hook-shape engaging elements, as male engaging elements, each formed of a monofilament yarn and a multiplicity of loop-shape engaging elements, as female engaging elements, each formed of a multifilament yarn stand in a mixed order from a front surface of a woven or knit substrate web is well known as disclosed in, for example, U.S. Pat. Nos. 3,130,111, 4,884,988 and 5,369,852, Japanese Patent Publication No. Sho 44-5569 and Japanese Patent Laid-Open Publication No. Sho 49-2649.

A pair of the identical composite surface fasteners can be detachably joined together by pressing against each other, with which complexity in production management, sewing, etc. would be avoided as compared to the ordinary surface fasteners each having only a multiplicity of male engaging elements or a multiplicity of female engaging elements.

However, in the composite surface fastener, since there exist in a mixed order the loop-shape female engaging elements having adequate softness and the hook-shape male engaging elements having adequate rigidness, it would make the engaging surface hard and would be difficult to avoid an itchy touch as compared to the ordinary female surface fastener member having only soft female engaging elements. To this end, an improved composite surface fastener was proposed as disclosed in, for example, U.S. Pat. No. 5,369,852. In the improved composite surface fastener, hook-shape or mushroom-shape male engaging elements are smaller in height than loop-shape female engaging elements formed of a multifilament yarn, so that the engaging surface is covered by the loop ends. A similar composite surface fastener, in which mushroom-shape male engaging elements instead of hook-shape engaging elements are smaller in height than loop-shape female engaging elements and which has the same construction as the one disclosed in the above-mentioned U.S. Pat. No. 5,369,852, is disclosed in, for example, U.K. Pat. No. 1345607.

However, the conventional composite surface fastener is lower in rate of engagement and peeling strength than the conventional ordinary surface fastener. Especially in the composite surface fasteners disclosed in U.S. Pat. No. 5,369,852 and U.K. Pat. No. 1345607, partly since loop-shape female engaging elements are larger in height than the male engaging elements and partly since the female engaging elements are difficult to deform due to the shape of the female engaging elements, it is lower in rate of engagement and peeling strength than the conventional ordinary composite surface fastener as the loop-shape female engaging elements would obstruct during engaging if the female engaging elements are equal in arrangement and density to the male engaging elements. Consequently, a special consideration is required to arrangement and distribution of the male and female engaging elements.

SUMMARY OF THE INVENTION

It is therefore an object of this invention to provide a composite surface fastener which gives a soft touch to an engaging surface and is improved in rate of engagement and peeling strength.

According to this invention, the above object is accomplished by a surface fastener comprising: a substrate; a multiplicity of male and female engaging elements standing in a mixed order from a front surface of the substrate; and a multiplicity of cut piles each formed of a multifilament, which is composed of a set of fibers, raised from the front surface of the substrate.

Preferably, the cut piles are larger in height above the front surface of the substrate than at least the male engaging elements. And the substrate is a woven or knit fabric, each of the female engaging elements being formed of a multifilament, each of the male engaging elements being formed of a monofilament, both the multifilament and monofilament of the female and male engaging elements being woven or knitted in the woven or knit fabric simultaneously with the weaving of the woven or knit fabric.

Usually, in a surface fastener consisted of the woven or knit fabric, heat-setting treatment is given in order to stabilize the shape of the engaging elements on the surface. In this invention, the cut piles are different in a heat-setting condition from the male engaging elements and are of a material such as not to be heat-set under the heat-setting condition of the male engaging elements.

In the above-mentiond woven or knit surface fastener, each of hook-shape engaging elements as a male engaging element is woven to be a loop at the time of weaving, and it is then cut by a cutter to be the hook. It is preferable to form the cut piles at the time of weaving. Therefore, the monofilament of the male engaging elements and the multifilament yarn of the cut piles are trued up as a double yarn woven or knitted in the substrate to have the identical loop shape, and then both of these loops are cut by the cutter to form the male engaging elements and the cut piles simultaneously. Partly because of the difference in heat-setting condition, the cut multifilament piles are raised scatteringly higher than the hook-shape engaging elements.

It is preferable that the cut piles thus formed do not have direct relation to the engaging function and that in order to give a soft tough to the engaging surface and not to obstruct the engaging function, the piles are of a material much in softness than the female and male engaging elements.

Further in this invention, the male engaging elements and the female engaging elements may have the same shape. In such a case, the shape of both of the male and female engaging elements may be the hook shape or a mushroom shape having an enlarged portion on an upper end of a stem.

Commonly, each of the male engaging elements may have a hook shape, and each of the female engaging elements may have a loop shape formed of the set of fibers of the multifilament. Each of the male engaging elements may have the mushroom shape having the enlarged head on the upper end of the stem, and each of the female engaging element may have the loop shape formed of the set of fibers of the multifilament. Further, in this invention, at least part of the substrate and the male engaging elements are molded of thermoplastic synthetic resin.

In an alternative form, each of the engaging elements may be a composite engaging element serving as either a male engaging element or a female engaging element and having a hook or mushroom shape.

DETAILED DESCRIPTION OF THE PREFERRED EMBODIMENTS

Figure 1A:
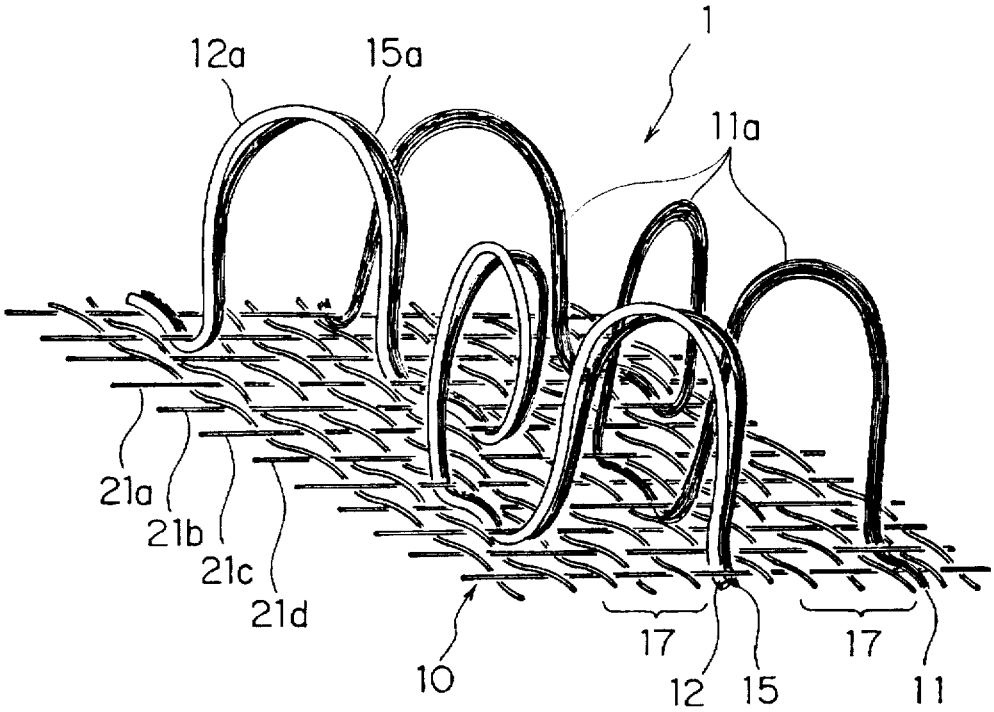
FIGS. 1(A) and 1(B) are fragmentary perspective views of a semiproduct and a final product, respectively, of a composite surface fastener according to a first embodiment of this invention.
Figure 1B:
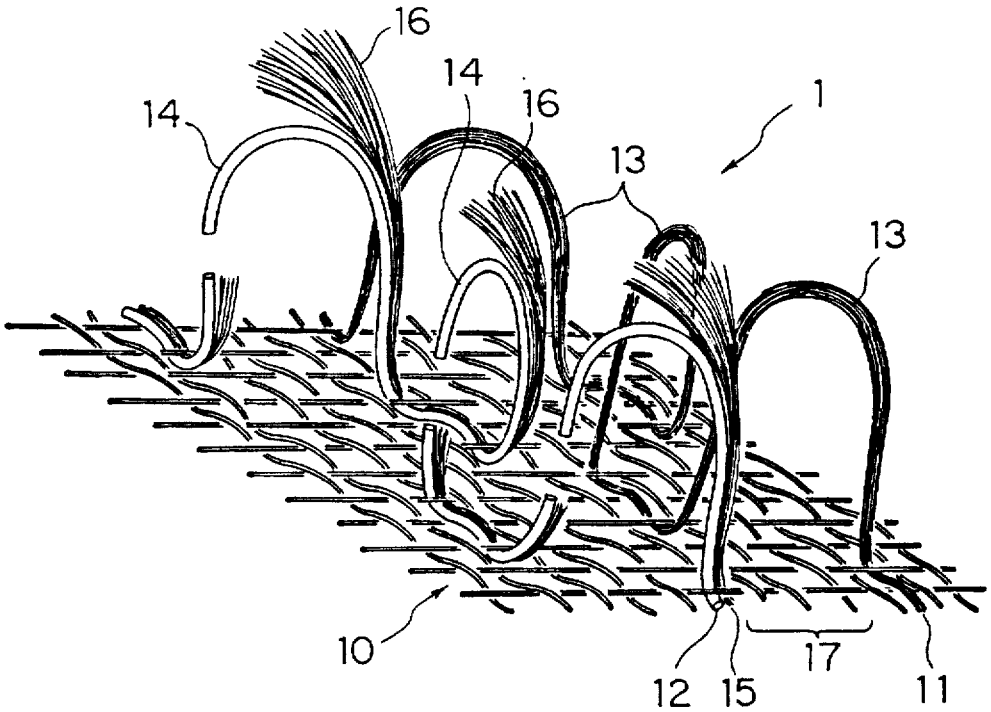
Figure 2A:
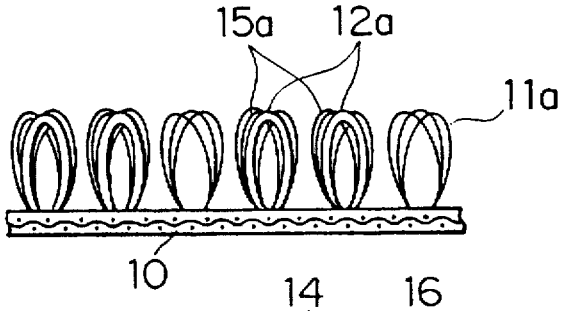
FIGS. 2(A) and 2(B) are fragmentary cross-sectional views of the semiproduct and the final product, respectively.
Figure 2B:
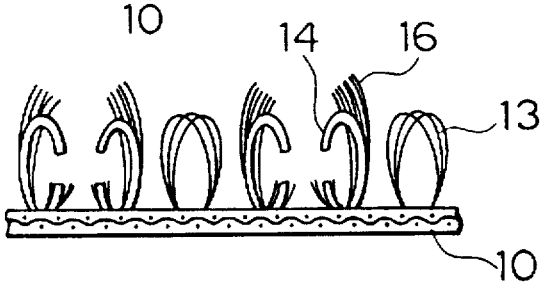

Various preferred embodiments of this invention will now be described in detail with reference to the accompanying drawings. FIGS. 1(A) and 1(B) are fragmentary perspective views of a semiproduct and a final product, respectively, of a woven composite surface fastener according to a first embodiment of the invention, and FIGS. 2(A) and 2(B) are schematic cross-sectional views of the semiproduct and the final product, respectively, of the same composite surface fastener. In this embodiment and hereinafter, a substrate composed of fibers only is called "substrate fabric 10".

In FIGS. 1(A), 1(B), 2(A) and 2(B), the composite surface fastener 1 of this embodiment is woven by an. ordinary weaving machine. The composite surface fastener 1 comprises the substrate fabric 10 consisting a woven ground structure, a number of first pile warp yarns 11 each forming a multiplicity of female engaging elements 13 described below, and a number of second pile warp yarns 12 each forming a multiplicity of male engaging elements 14 rising from the front surface of the substrate fabric 10. Each first pile warp yarn 11 is a multifilament, and each second pile warp yarn 12 is a monofilament. The first and second pile warp yarns 11, 12 are arranged in predetermined rows on the front surface of the substrate fabric 10 and woven in a mixed order in the substrate fabric 10.

The fiber material of the substrate fabric 10 may be synthetic fibers, such as polyester fibers, polyamide fibers, polyacryl fibers and polypropylene fibers, or ordinary semi-synthetic fibers or natural fibers. On the other hand, the material of the first and second pile warp yarns 11, 12 may be the above-mentioned synthetic fibers. In the illustrated embodiment, each of the first pile warp yarns 11 forming the female engaging elements 13 is a multifilament of polyamide synthetic resin, and each of the second pile warp yarns 12 forming the male engaging elements 14 is a monofilament of polyester resin. Alternatively, the first and second pile warp yarns 11, 12 may be of the same material. In an alternative form, the materials of the first and second pile warp yarns 11, 12 may be any combination of different kinds of synthetic resins.

The foregoing construction of the composite surface fastener 1 is identical with the basic structure of the conventional composite surface fastener woven of fibers. The composite surface fastener 1 is differentiated over the conventional composite surface fastener by cut piles 16 each formed of a set of fibers woven in the substrate fabric 10 and being raised in a substantially upright posture from the front surface of the substrate fabric 10.

According to the first embodiment of FIG. 1, the cut piles 16 are formed by truing up a multifilament yarn 15, which is composed a set of twist fibers small in denier, with the monofilament yarn of the second pile warp yarn 12 as a double yarn and weaving the double yarn in the substrate fabric 10 simultaneously, and then cutting the multifilament yarn 15 with the monofilament of the second pile warp yarn 12 as described below. In the illustrated example, the monofilament of the second pile warp yarn 12 and the multifilament yarn 15 of the cut piles 16 extend warpwise across three weft yarns 21*a*–21*c*, under the first weft yarn 21*a*, then over the second weft yarn 21*b* and then under the third weft yarn 21*c*, whereupon they extend warpwise over a single weft yarn 21*d* following the above-mentioned three weft yarns 21*a*–21*c*, striding weftwise in a loop over three warp yarns 17 of the ground structure. Again they extend warpwise across next three weft yarns 21*a*–21*c*, under the first weft yarn 21*a*, then over the second weft yarn 21*b* and then under the third weft yarn 21*c*, whereupon they extend warpwise over a single weft yarn 21*d* following the second-named three weft yarns 21*a*–21*c*, striding in a loop over the above-mentioned three warp yarns 17. As this weaving pattern is repeated, the monofilament of the second pile warp yarn 12 and the multifilament yarn 15 for the cut piles 16 form a multiplicity of loops 12*a*, 15*a*, respectively, standing on the front surface of the substrate fabric 10 as shown in FIG. 1(A). The basic structure formed of the three warp yarns 17 and the four weft yarns 21*a*–21*d* is plain-weave.

In the meantime, the multifilament of each first pile warp yarn 11 forms a multiplicity of loops 11*a*, which serve as the female engaging elements 13, standing on the front surface of the same substrate fabric 10, being adjacent to the second pile warp yarn 12 and the multifilament yarn 15 which are trued up and woven in the ground structure. The woven structure for forming the loops 11*a* is identical with that for forming the male engaging elements 14 and the cut piles 16, except that the weaving pattern of the first pile warp yarn 11 is shifted warpwise by one weft yarn 21. As a result, the male engaging elements 14 and the cut piles 16 are staggered warpwise by one weft yarn with the female engaging elements 13.

The height of the loops 11*a*, which serve as the female engaging elements 13, above the front surface of the substrate sheet 10 is equal to or slightly larger than the height of the loops 12*a* of the monofilament and those of the loops 15*a* of the multifilament yarn 15. However, if the height of the loops 11*a* serving as the female engaging elements 13 is set larger than the remaining loops, it is necessary to set that height smaller than the height of the cut piles 16 after a cutting process described below. In this embodiment, between the double yarn, which is composed of the monofilament pile warp yarn 12 and the multifilament yarn 15, and the first pile warp yarn 11, one ground-structure warp yarn 17 is woven in the substrate fabric 10 so as to extend alternately under and over the weft yarns 21*a*–21*d*, namely, under every other weft yarns 21*a*, 21*c* and over every other weft yarns 21*b*, 21*d*. As the loops 12*a*, 15*a*, 11*a* respectively of the male engaging elements 14, the cut piles 16, and the female engaging elements 13 are woven simultaneously of the weaving of the substrate fabric 10 so as to weave the composite surface fastener fabric, the composite surface fastener 1 is then heat-set for stabilize the shape of the male engaging elements 14 and the shape of the female engaging elements 13. At that time, it is preferable to select, for the multifilament yarn 15 for the cut piles 16, such a material that its heat-setting temperature is higher than the heat-setting temperature of the male engaging elements 14 and the female engaging elements 13.

Then one side of each of loops 12*a*, 15*a* of the male engaging elements 14 and the cut piles 16 is cut by a known cutting blade like barber's clippers, so that the loop 12*a* of monofilament is formed into a hook-shape male engaging element 14 with one side being cut and, at the same time, a curved upper end of the loop 15*a* of the multifilament consisting the cut pile 16 resiliently restores so as to have a slightly curved upper end, as shown in FIG. 1(B). At that time, the height of the cut piles 16 above the front surface of the substrate fabric 10 is larger than that of the male and female engaging elements 14, 13, and the set of fibers of each cut pile 16 is raised along the adjacent male engaging element 14.

The substrate fabric 10 of the thus obtained composite surface fastener 1 is backed with synthetic resin. The material of this backing may be a much adhesive synthetic resin, such as polyester resin, polyamide resin and polyacryl resin like the above-mentioned fiber material, a polyurethane resin, or various kinds of synthetic rubber. This synthetic resin backing is provided by coating the rear surface of the substrate fabric 10 with a molten synthetic resin or a synthetic resin solution in which synthetic resin, together with a filler, a surface active agent and a hardener, is dissolved in a suitable solvent, then pressing the coated surface by a suitable means to impregnate the liquid synthetic resin into the substrate fabric and then heating the coated surface to anchor the base ends of the female and male engaging elements 13, 14 and cut piles 16 to the substrate fabric 10.

The composite surface fastener 1 of this embodiment, like the conventional composite surface fastener, is easy to join with a companion composite surface fastener 1 of the same construction by pressing and is easy to peel off the companion composite surface fastener 1 by picking up one end of the composite surface fastener 1. Further, with the composite surface fasteners 1 of this embodiment, it is possible to avoid complexity in inventory control and sewing.

As a most notable feature of this invention, in the composite surface fastener 1 of this embodiment, partly since the front surface of the substrate sheet 10, from which the female and male engaging elements 13, 14 stand, is covered throughout the substantially entire area with fibers of cut piles 16, with the upper ends of the female and male engaging elements 13, 14 slightly projecting, and partly since the cut piles 16 exist adjacent to the hook-shape male engaging elements 14, the engaging surface of the composite surface fastener 1 can display a soft touch approximate to ordinary velvet and is remarkably purged of rigid and itchy touches caused by the male engaging elements as conventional. Further, since the cut piles 16 are composed of a multiplicity of fibers merely raised, the male engaging elements 14 would receive a small reaction, when penetrating into the engaging surface of a companion surface fastener, as compared to the conventional arrangement disclosed in, for example, U.S. Pat. No. 5,369,852, in which loop-shape female engaging elements of multifilament are slightly larger in height than hook-shape male engaging elements of monofilament. Thus, penetration of the male engaging elements into the engaging surface of the companion surface fastener is facilitated and hence the rate of engagement is increased to cause an increased degree of engaging strength.

Figure 3A:
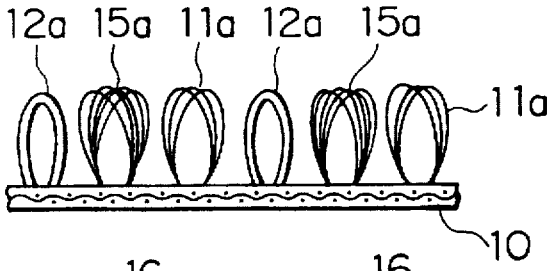
FIGS. 3(A) and 3(B) are fragmentary cross-sectional views of a semiproduct and a final product, respectively, of another composite surface fastener according to a second embodiment.
Figure 3B:
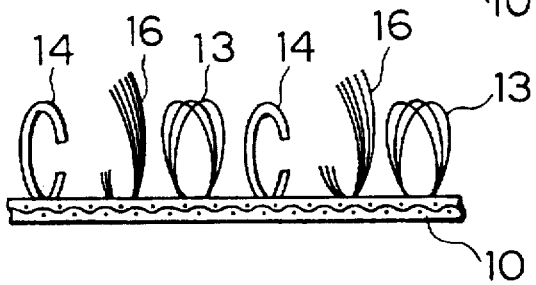

FIGS. 3(A) and 3(B) are fragmentary cross-sectional views of a semiproduct and a final product, respectively, of a fiber-made composite surface fastener according to a second embodiment of this invention. In FIGS. 3(A) and 3(B), elements or parts substantially similar to those of the first embodiment are designated by like reference numerals. As shown in FIG. 3(A), on the front surface of the substrate fabric 10, loops 12*a*, 15*a*, 11*a* for the male engaging element 14 of the monofilament, the cut pile 16 of the multifilament and the female engaging element 13 of the multifilament, respectively, are formed repeatedly in this order weftwise as a semiproduct for the composite surface fastener is woven.

After the semiproduct is heat-set likewise the first embodiment, the confronting sides of the adjacent loops 12*a* 15*a* for the male engaging elements 14 of the monofilament and for the cut piles 16 of the multifilament are cut to form the hook-shape male engaging elements 14 and the cut piles 16 of sets of fibers raised arcuately to project from the upper ends of the female and male engaging elements 13, 14, as shown in FIG. 3(B).

Figure 4A:
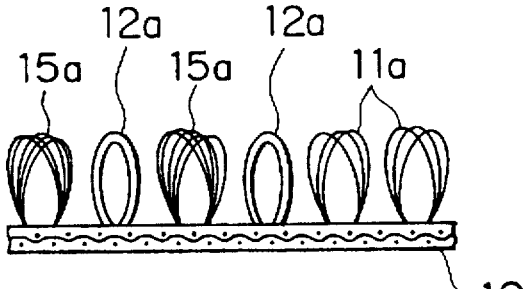
FIGS. 4(A) and 4(B) are fragmentary cross-sectional views showing a modification of the second embodiment.
Figure 4B:
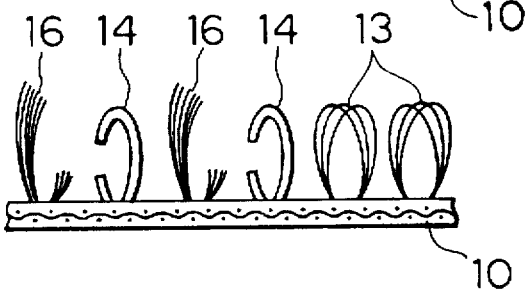

FIGS. 4(A) and 4(B) are fragmentary cross-sectional views showing a modification of the embodiment of FIGS. 3(A) and 3(B). The modification is differentiated from the second embodiment by a different arrangement that loops 12*a*, 15*a*, 11*a* for the male engaging element 14, the cut pile 16 and the female engaging element 13 are formed repeatedly in a pattern different from the one shown in FIGS. 3(A) and 3(B).

Specifically, on the front surface of the substrate fabric 10, the loops 15*a*, 12*a*, 15*a*, 12*a*, 11*a*, 11*a* for the cut pile 16 of the multifilament, the male engaging element 14 of the monofilament, the cut pile 16 of the multifilament, the male engaging element 14 of the monofilament, the female engaging element 13 of the multifilament and the female engaging element 13 of the multifilament, respectively, are formed repeatedly in this order weftwise as a semiproduct of FIG. 4(A) for the composite surface is woven. After the semiproduct is heat-set, the confronting sides of the two pairs of adjacent loops 15*a* for the cut piles 16 of the multifilament and 12*a* for the male engaging element 14 of the monofilament are cut to form the hook-shape male engaging elements 14 and the cut piles 16 of sets of fibers raised arcuately to slightly project from the upper ends of the female and male engaging elements 13, 14, as shown in FIG. 4(B).

Figure 5A:
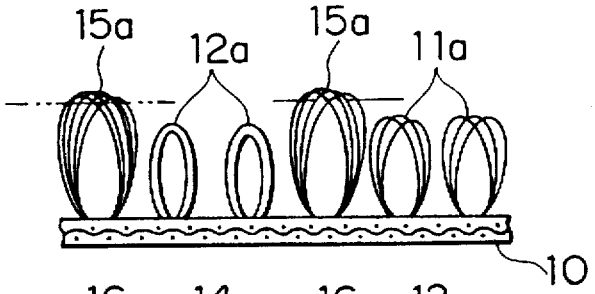
FIGS. 5(A) and 5(B) are fragmentary cross-sectional views of a semiproduct and a final product, respectively, of still another composite surface fastener according to a third embodiment.
Figure 5B:
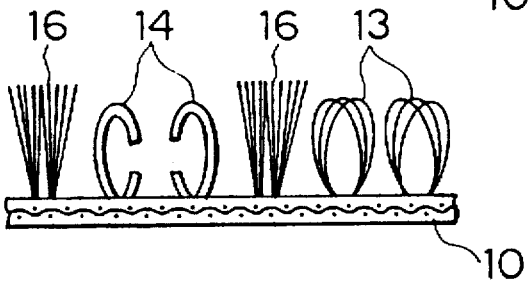

FIGS. 5(A) and 5(B) show a semiproduct and a final product, respectively, of a fiber-made composite surface fastener according to a third embodiment. This embodiment is characterized in that the cut piles 16 are formed in a different method. Accordingly, the pattern of arrangement of the loop 12*a* for the male engaging element 14 of monofilament, the loop 15*a* for the cut pile 16 of multifilament, and the loop 11*a* for the female engaging element 13 of multifilament are only an illustrative example, and various alternatives may be suggested.

According to this embodiment, as shown in FIG. 5(A), a single loop 15*a* for the cut pile 16 is formed between a pair of loops 12*a*, 12*a* adjacent weftwise for the male engaging elements 14, 14 of the monofilament and a pair of loops 11*a*, 11*a* adjacent weftwise for the female engaging elements 13, 13 of the multifilament as being woven in the substrate fabric 10. Further, the loops 15*a* for the cut piles 16 are set adequately higher than the remaining loops 11*a*, 12*a* as shown in FIG. 5(A).

From the thus obtained semiproduct, the composite surface fastener of FIG. 5(B) is manufactured by cutting confronting sides of loops 12*a*, 12*a* of two adjacent male engaging elements 14 of monofilament in the usual method and, at the same time, cutting the upper portion of each of loops 15*a*, 15*a* for the cut piles 16 of multifilament yarns 15, 15 along a phantom line in FIG. 5(A). At that time, it is efficient to cut the upper portion of the loop 15*a* for the cut piles 16 in the same manner as that in the ordinary velvet production. And the level of the cutting line is set in such a manner that the cut piles 16 are slightly higher than the female and male engaging elements 13, 14 like above-described embodiments.

Figure 6A:
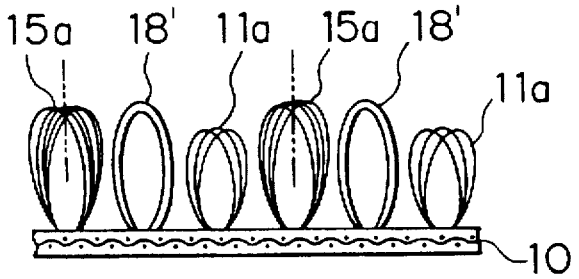
FIGS. 6(A) and 6(B) are fragmentary cross-sectional views of a semiproduct and a final product, respectively, of a further composite surface fastener according to a fourth embodiment.
Figure 6B:
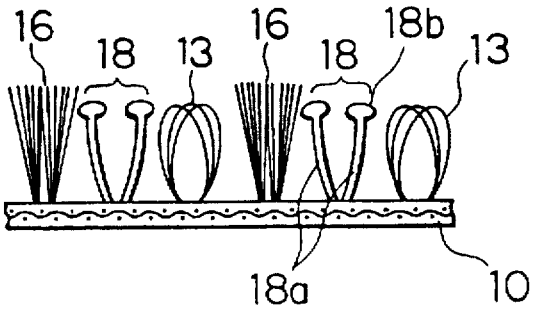

FIGS. 6(A) and 6(B) show a fourth embodiment of this invention. According to this embodiment, the hook-shape male engaging elements 14 formed of monofilament are substituted by mushroom-shape male engaging elements 18 of the monofilament, each of which has a generally hemispheric head 18*b* bulging from the upper end of a stem 18*a* standing on the substrate fabric 10, as shown in FIG. 6(B). The mushroom-shape male engaging elements 18 may be formed in the conventional method well known in the art. Namely, after the lapse of two minutes from the cutting of the upper ends of loops 18' for the male engaging elements 18, the cut ends are melted by pressing them against a heating plate having on its front surface a multiplicity of dimples or by bringing a heating source close to the cut ends.

FIGS. 7(A), 7(B), 8(A) and 8(B) show a fifth embodiment of this invention. In this embodiment, the substrate composed of the fibers and synthetic resin material is called "substrate sheet 10". A composite surface fastener 1' of the fifth embodiment is differentiated from each of the foregoing embodiments, in which the whole composite surface fastener is consisted of fiber materials, by molding part of the substrate sheet 10' and all of male engaging elements 19 consisted of hook elements of synthetic resin. On the other hand, the remaining part of the substrate sheet 10', female engaging elements 13 and piles 16 are formed of fibers likewise the foregoing embodiments.

The composite surface fastener 1' according to the fifth embodiment, in which members are of different materials and manufacturing methods, may be continuously manufactured by supplying a woven or knit pile cloth, together with molten resin, to the circumferential surface of a die wheel which is substantially identical in construction with the conventional die wheel for molding a molded surface fastener.

One example of the die wheel will now be described in brief. The die wheel has in its circumferential surface a multiplicity of male-engaging-element-forming cavities in circumferential rows spaced at regular distances in a direction parallel to the axis of rotation of the die wheel, there being a circumferential ring-shape groove extending along and between each adjacent pair of cavity rows. The basic structure of the die wheel may be obtained by slightly modifying the die wheel disclosed in U.S. Pat. No. 4,775,310, so its description is limited to the minimum here. The die wheel is a hollow drum having a water-cooling jacket inside and composed of a number of ring-shape plates fixedly placed one over another along its axis in a laminate form. Cavity rows are composed of a multiplicity of hook-element-forming cavities, base ends of which open at the circumferential edge portions of ring-shape plates of the same diameter. Between each adjacent pair of rows of hook-element-forming cavities, there disposed ring-shape plates in the laminate, having a diameter smaller than the ring-shape plates consisting the cavity rows, to define the groove. The die wheel is driven for rotation by a known synchronous drive unit.

An injection die is disposed to confront the circumferential surface of the die wheel, which is in positive rotation, with a predetermined gap for injecting molten resin in a sheet from an orifice of the injection die under a predetermined resin pressure. In the meantime, a woven or knit pile cloth (hereinafter called as pile sheet member) is supplied from a pile-cloth roll to the gap between the orifice of the injection die and the circumferential surface of the die wheel with a predetermined tension while touching part of the circumferential surface of the die wheel. A guide roller is disposed at a position downstream and diagonally upward of the die wheel, namely, on the opposite side of the die wheel with respect to the orifice of the injection die. Downstream of the guide roller, a vertical pair of take-up rollers rotatable at a speed synchronous with the speed of rotation of the die wheel is disposed.

Figure 7A:
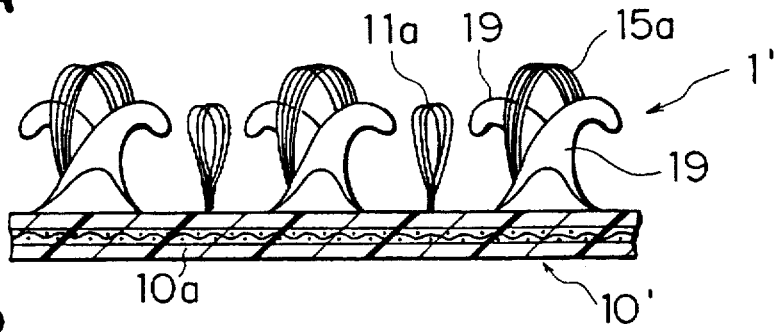
FIGS. 7(A) and 7(B) are fragmentary cross-sectional views of a semiproduct and a final product, respectively, of a still further composite surface fastener, in which part of a substrate sheet and male engaging elements are molded of synthetic resin, according to a fifth embodiment.
Figure 7B:
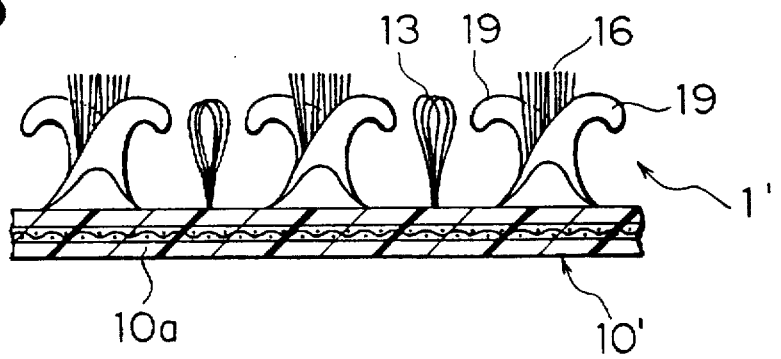

The pile sheet member to be used in the fifth embodiment of FIGS. 7(A) and 7(B) has a ground structure coarse enough to allow molten resin to percolate through. The molten resin molded in the shape of the composite surface fastener on the circumferential surface of the die wheel is moved in an arc around a substantially half of the circumferential surface of the die wheel as guided by the guide roller, during which the molten resin is cooled from the inside of the die wheel so that the substrate sheet 10', in which part of the pile sheet member is embedded, and the hook-shape male engaging elements 19 integral with the substrate sheet 10' are gradually solidified. The resulting sheet-shape semiproduct for the composite surface fastener 1' is moved around a substantially half of the circumferential surface of the die wheel and then continuously removed as positively drawn by the take-up rollers via the guide roller. As a result, the loops 15*a* for the cut piles 16 higher than the hook elements 19 and the loops 11*a* substantially equal in height to the hook elements 19 are formed rising alternately from the front surface of the substrate sheet 10', as shown in FIG. 7(A).

In the fifth embodiment of FIGS. 7(A) and 7(B), each of the loops 15*a* for the cut piles 16 are formed centrally between each weftwise adjacent pair of hook elements 19 on the substrate sheet 10', while each of the loops 11*a* for the female engaging elements 13 are formed centrally between each adjacent set of four hook elements 19. In this arrangement of the loops 15*a* for the cut piles 16, after the loops 15*a* are cut, the cut piles 16 are raised to project over the hook elements 19 so that a soft, less itchy touch of the engaging surface can be displayed as compared to the other arrangements. In this embodiment, the hook elements 19 in adjacent rows are directed in opposite directions. However, the arrangement of the loops 11*a* for the female engaging elements and the loops 15*a* for the cut piles and the orientation of the hook elements 19 should by no means be limited to the illustrated example.

The upper ends fo the loops 15*a* for the cut piles 16 of the thus manufactured semiproduct are cut at position shwon by the phantom line in FIG. 7(A), so that the composite surface fastener 1' of this invention having the shape shown in FIG. 7(B) is manufactured. In the embodiment of FIGS. 7(A) and 7(B), the cut piles 16 are formed by cutting the upper ends of the loops 15*a* for the cut piles 16 after manufacturing the semiproduct. However, the upper ends of the loops 15*a* for the cut piles 16 may be previously cut before introducing the pile sheet member between the die wheel and the injection nozzle.

Figure 8A:
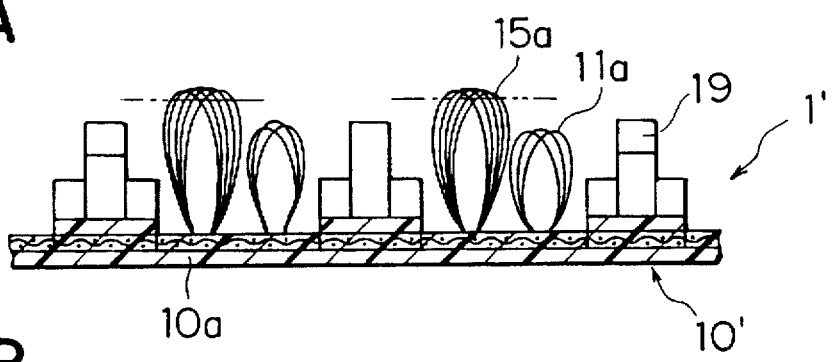
FIGS. 8(A) and 8(B) are fragmentary cross-sectional views of a semiproduct and a final product, respectively, of a modification of the fifth embodiment.
Figure 8B:
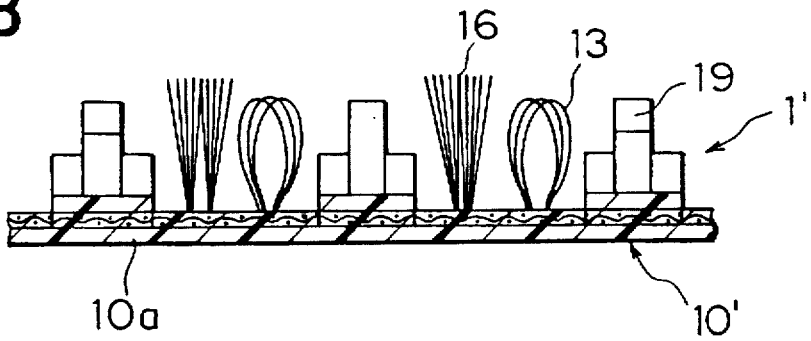

FIGS. 8(A) and 8(B) show a modification of the fifth embodiment of FIGS. 7(A) and 7(B). According to this modification, the hook elements 19 and the female engaging elements 13 formed in the hook rows are arranged in such a manner that the hook element 19, the cut pile 16 and the female engaging element 13 are formed repeatedly in this order weftwise of the composite surface fastener.

A pile sheet member to be used in this modification is divided into a number of alternately arranged pile-existing high-density regions and pile-free coarse regions by a predetermined width. The ground structure of the pile-existing high-density region is woven or knitted in such a high density as not to allow molten resin to percolate through, while the pile-free coarse region has pores large enough to allow molten resin to percolate through easily. Further, in the pile-existing region, the loops 15*a* of multifilament for the cut piles 16 of greater height are woven to be arranged longitudinally at the same pitch as that of the hook-element-forming cavities in the circumferential surface of the die wheel, and centrally between longitudinally successive loops 15*a* for the cut piles, loops 11*a* of multifilament for the female engaging elements 13 having the smaller height are woven. The pile surface of the woven or knit cloth may be processed by napping so that the pile surface can be soft or downy with the loops 11*a*, 15*a* of multifilament directed in substantially all directions.

For molding the composite surface fastener 1' of this modification, molten resin continuously injected from the injection die under a predetermined resin pressure is continuously supplied into the gap defined between the injection die and the die wheel in rotation. At the same time, the pile sheet member also is introduced into the gap along the circumferential surface of the die wheel with the loops 11*a*, 15*a* received in and guided along the ring-shape grooves each formed between each adjacent pair of hook-element-forming cavity rows of the die wheel, so that part of molten resin is impregnated into the ground structure of the pile-existing region of the pile sheet member on the orifice side while part of molten resin is percolated through the pores of the pile-free coarse region to the circumferential surface of the die wheel to fill in the hook-element-forming cavities successively, thus molding the hook-elements 19 and expanding uniformly between the pile-free coarse region and the hook-element-forming cavities. As a result, the molten resin staying on the orifice side of the injection die and the expanded molten resin are integrally fused with the material of the pile sheet member to form the part 10*a* of the substrate sheet 10' in a predetermined thickness.

Figure 9:
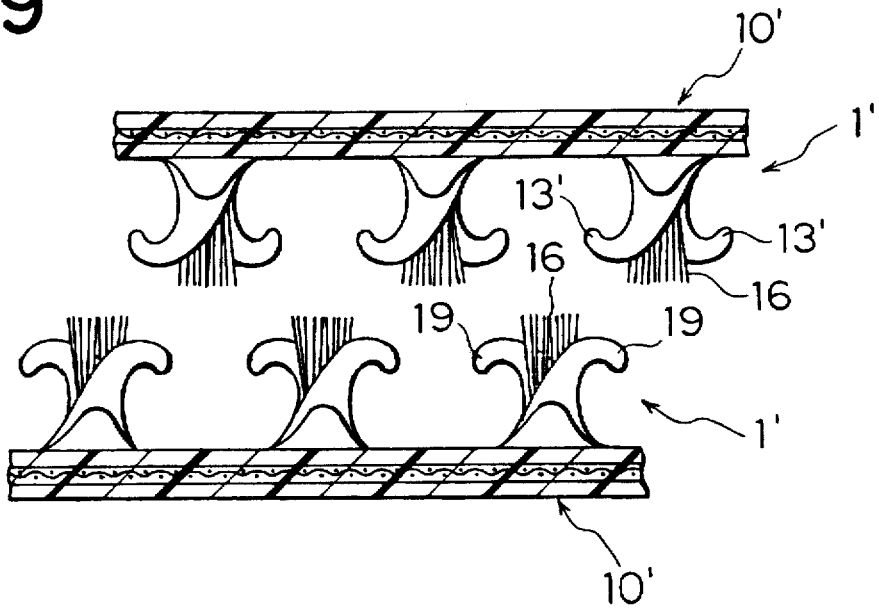
FIG. 9 shows the manner in which a pair of composite surface fasteners are to be engaged according to another modification of the fifth embodiment.

FIG. 9 shows another modification of the fifth embodiment of FIGS. 7(A) and 7(B). According to this modification, the hook elements 19 as the male engaging elements, which are molded of synthetic resin, serve also as the female engaging elements 13'; a pair of identical composite surface fasteners 1', 1' can be joined with and separated from each other by pressing against and peeling off each other's engaging surface. It is therefore possible to omit the loops 11*a* of multifilament for the female engaging elements 13' which has the same shape as the hook elements 19.

In each of the foregoing embodiments, the male engaging elements 14, 18, 19 have a highest degree of rigidity. With respect to the female engaging elements 13 and the cut piles 16, it is preferable to select, for the fibers of the multifilament of the cut piles 16, a softer material than that for the fibers of the multifilament of the female engaging elements 13. The factors to determine the degree of softness is exemplified by the kind of synthetic resin, and in case of identical resin material the additives, the quantity of additives, and the size of fibers.

As is apparent from the foregoing description, in the composite surface fastener according to this invention in which the male and female engaging elements 13, 13', 14, 18, 19 are formed on the same surface of the substrate 10, 10', partly since the multiplicity of cut piles 16 formed of sets of fibers are arranged on the composite engaging surface of the substrate sheet, and partly since the cut piles 16 are higher than the male and female engaging elements 13, 13', 14, 18, 19 in such a manner that the entire male and female engaging elments 13, 13', 14, 18, 19 are covered with the fibers of the cut piles 16, it is possible to prevent the rigid male engaging elements from direct contact with the user's skin, which would have happened to occur with the conventional composite surface fastener, thus wiping out the conventional itchy touch and giving a soft or downy touch instead.

In comparison with the conventional composite surface fastener in which the cut piles are taller than the male engaging elements, the engaging surface is comfortable in touch, and moreover, when the surface fasteners are pressed to be joined with each other, the male engaging elements 14, 18, 19 are allowed to penetrate into the companion engaging surface to increase the rate of engagement and hence to improve the degree of engaging strength. This is because, in the conventional surface fastener, pile-shape female engaging elements have much bounce to prevent the male engaging elements from penetrating, whereas in this invention, merely the fibers of upright posture project from the engaging surface.

What is claimed is:

1. A surface fastener comprising:

(a) a substrate;

(b) a multiplicity of male and female engaging elements standing in a mixed order from a front surface of said substrate; and (c) a multiplicity of cut piles each formed of a multifilament, which is composed of a set of fibers, raised from said front surface of said substrate.

2. A surface fastener according to claim 1, wherein said cut piles are larger in height above said front surface of said substrate than at least said male engaging elements.

3. A surface fastener according to claim 1, wherein said substrate is a woven or knit fabric, each of said female engaging elements being formed of a multifilament, each of said male engaging elements being formed of a monofilament, both said multifilament and monofilament of said female and male engaging elements being woven or knitted in said woven or knit fabric simultaneously with the weaving of said woven or knit fabric.

4. A surface fastener according to claim 3, wherein said cut piles are different in a heat-setting condition from said male engaging elements and are of a material such as not to be heat-set under the heat-setting condition of said male engaging elements.

5. A surface fastener according to claim 3, wherein said monofilament of said male engaging elements and said multifilament of said cut piles are trued up as a double yarn woven or knitted in said simultaneously with the weaving or knitting of said substrate.

6. A surface fastener according to claim 1, wherein said cut piles are of a material much in softness than said female and male engaging elements.

7. A surface fastener according to claim 1, wherein each of said male engaging elements has a hook shape, and each of said female engaging elements has a loop shape formed of said set of fibers of said multifilament.

8. A surface fastener according to claim 1, wherein each of said male engaging elements has a mushroom shape having an enlarged head on an upper end of a stem, and each of said female engaging element has a loop shape formed of said set of fibers of said multifilament.

9. A surface fastener according to claim 1, wherein at least part of said substrate and said male engaging elements are molded of thermoplastic synthetic resin.

10. A surface fastener according to claim 9, wherein said female engaging elements also are molded of thermoplastic synthetic resin, each of said female engaging elements having a hook shape similar to that of each of said male engaging elements.

11. A surface fastener according to claim 9, wherein each of said engaging elements is a composite engaging element serving as either a male engaging element or a female engaging element and having a hook shape.

* * * * *